US007335109B2

(12) United States Patent
Chen

(10) Patent No.: US 7,335,109 B2
(45) Date of Patent: Feb. 26, 2008

(54) TURBULENT TASSEL CHAMBER

(76) Inventor: Samuel Chen, Flat M. 3 floor, Kaiser Estate Phase, 3 Hok Yuen Street, Hong Kong, Kowloon (CN)

( * ) Notice: Subject to any disclaimer, the term of this patent is extended or adjusted under 35 U.S.C. 154(b) by 749 days.

(21) Appl. No.: 10/861,666

(22) Filed: Jun. 4, 2004

(65) Prior Publication Data

US 2005/0284031 A1 Dec. 29, 2005

(51) Int. Cl.
*A63G 31/12* (2006.01)

(52) U.S. Cl. ..... 472/134; 446/220; 52/2.11

(58) Field of Classification Search ..... 472/134; 446/220, 221, 223; 52/2.11, 2.17, 2.23
See application file for complete search history.

(56) References Cited

U.S. PATENT DOCUMENTS 643,493 A * 2/1900 Fuller ..... 472/65
5,462,505 A * 10/1995 Blair et al. ..... 482/27
5,678,357 A * 10/1997 Rubio et al. ..... 52/2.17
6,364,782 B1 * 4/2002 Ochi ..... 472/134
7,089,703 B2 * 8/2006 Brereton ..... 52/2.23
7,108,608 B2 * 9/2006 Field et al. ..... 472/134

* cited by examiner

*Primary Examiner*—Kien Nguyen
(74) *Attorney, Agent, or Firm*—Clement Cheng

(57) ABSTRACT

A turbulent tassel column has an inflatable clear column member containing tassels held inside the column. The tassels circulate freely or are wall attached within the transparent column member. An inverted cone member held within the inflatable member directs airflow blowing tassels. The inverted cone member has an exit aperture and an input aperture. The input aperture receives airflow from the bottom of the column and directs airflow through an exit aperture. Tassels accumulating at the bottom of the input aperture receive airflow arriving from the bottom of the column at the input aperture.

17 Claims, 2 Drawing Sheets

TURBULENT TASSEL CHAMBER

DISCUSSION OF RELATED ART

A variety of inflatable structures have been introduced allowing children to play inside an inflatable room. These inflatable structures are portable and often rented for parties. Many inflatable structures additionally include a bouncing cell allowing the structure to function as a trampoline. A review of the marketplace shows that the inflatable structures are works of art displaying a wide variety of shapes and themes. A wide variety of members can be connected and disconnected for creating a fun inflatable structure.

A common construction is the four wall rectangular inflatable structure having a square base and four vertical columns connecting at an upper member that acts as a roof. Often, coarse netting bounds the walls. The structure is commonly made of plastic PVC or similar material in basic primary colors.

A review of patents granted she regarding the inflatable structures shows again a wide variety of construction. U.S. Pat. No. 6,565,405 shows an interconnecting inflatable play structure having connecting walls formed from arched members, wall members and window members. U.S. Pat. No. 5,893,238 shows a flexible inflatable tent construction including an upper wall unit, a lower wall unit and a plurality of vertically aligned inflatable tubular chambers. The device also has vertical members and a base member. Although the patents granted only show a small portion of the total number of designs, they do reflect the current state of inflatable structure construction.

DETAILED DESCRIPTION OF THE PREFERRED EMBODIMENT

Figure 1:
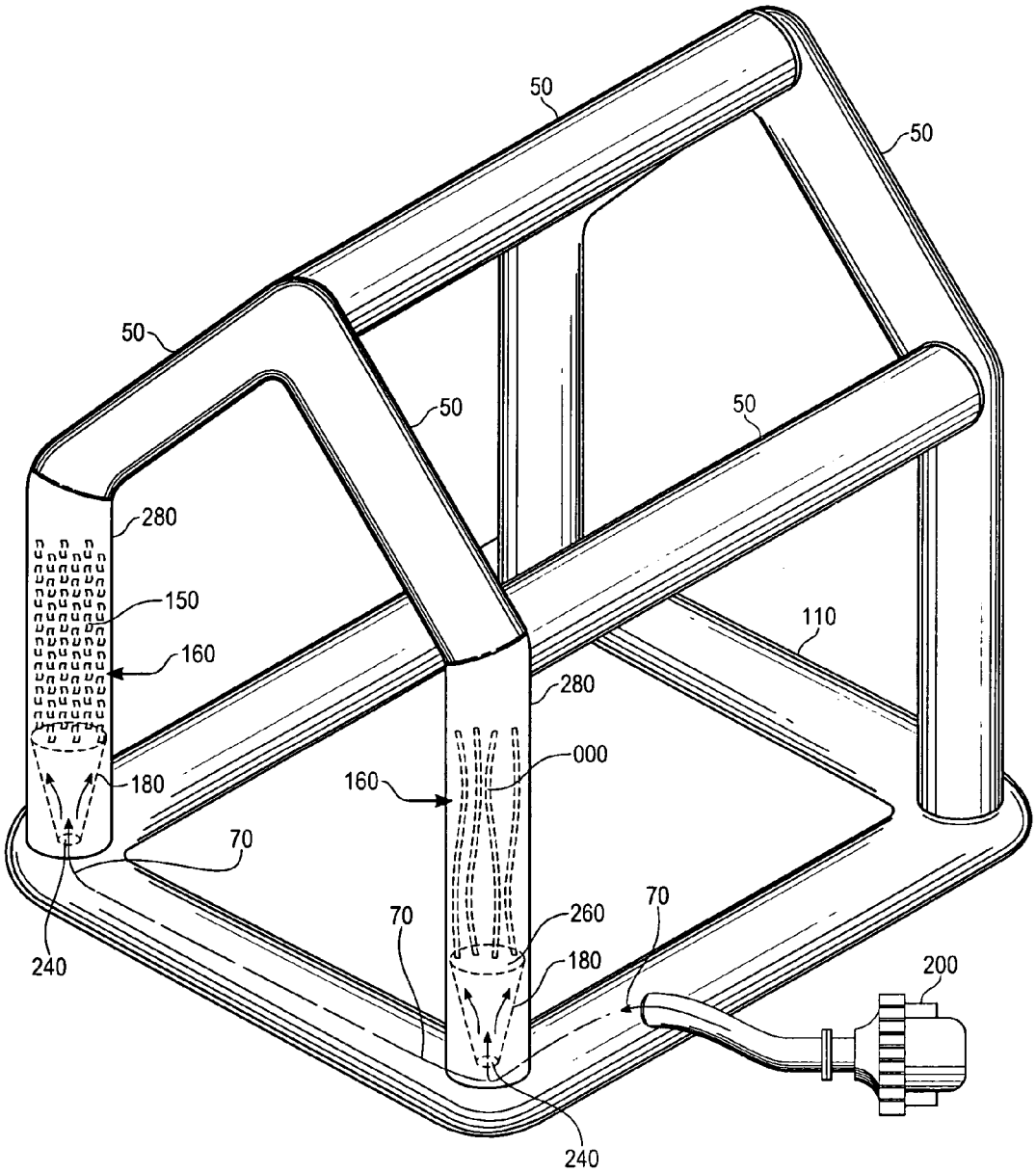
FIG. 1 is a perspective view of the present invention.
Figure 2:
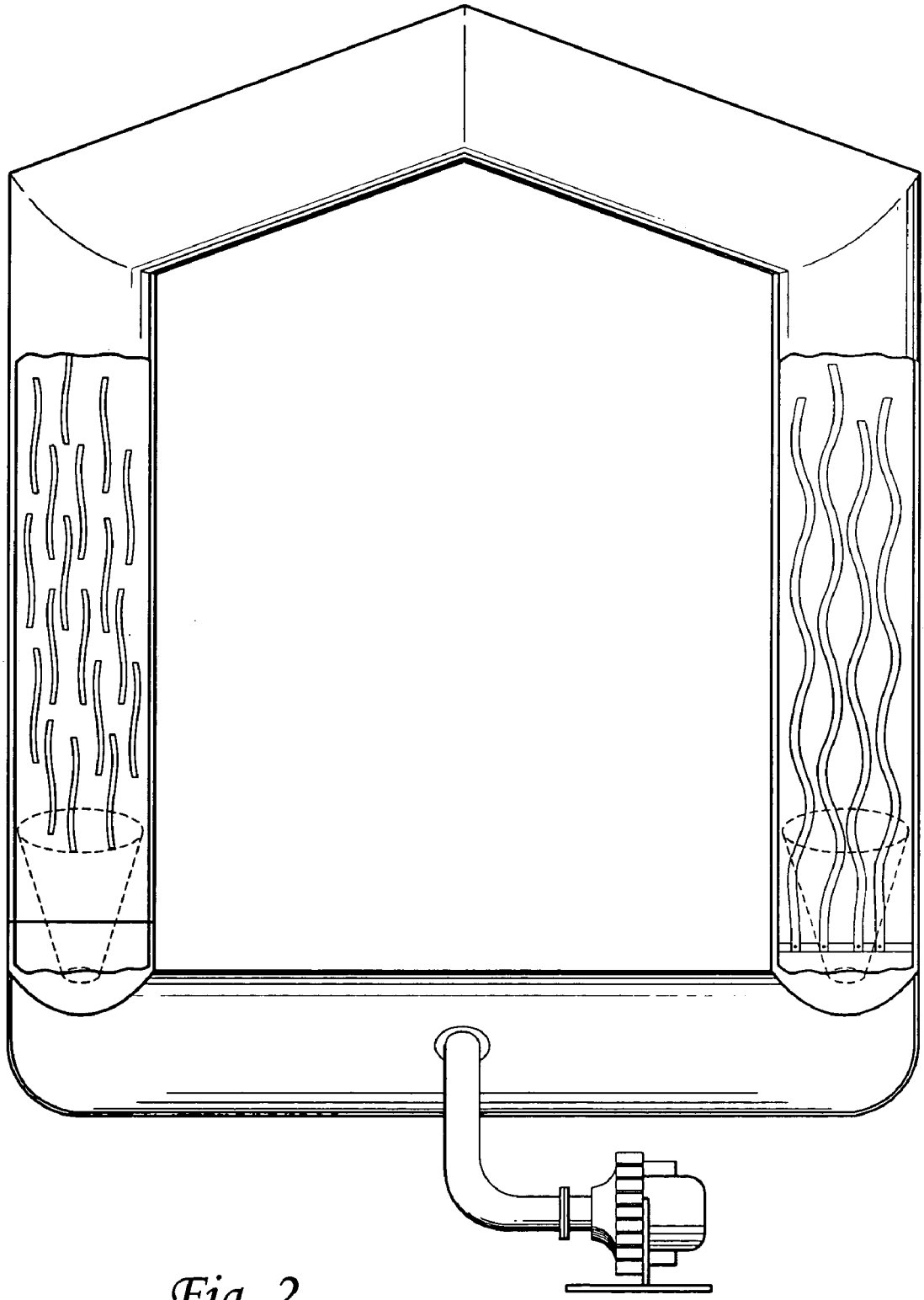
FIG. 2 is a cross section view of the present invention.

FIG. 1, a fan or other air pumping means creates airflow producing and maintaining air pressure within a number of clear transparent plastic members arranged to form an inflatable structure. Children may jump on the inflatable jumper having an inflatable base, and several inflatatable columns or walls forming an inflatable structure.

The jumper has at least one inflatable clear transparent plastic member. The column has a top opening and a bottom opening preferably formed in cylindrical configuration. Air flows from the bottom opening through the cylinder to the top opening. A clear transparent column plastic member contains a number of colorful tassels mounted within. The column also contains an inverted cone that is clear transparent and directs airflow across tassels. Airflow passing through the column plastic member blows tassels creating motion maintaining an entertaining and attractive visual effect.

In figure one, a pair of columns 160 appears as vertical column support structures. Other orientations include horizontal and vertical. Also, a wide variety of angles can be made by the vertical column support structures. The vertical column support structures can also be curved and have varying cross sections. The clear transparent column member appears as an architectural column and being inflatable is substantially hollow and made of a material or fabric shell capable of retaining air. Preferable materials include PVC, nylon and related plastic or rubber materials.

The tassels are mounted inside the column and can be adhered to the inside surface of the column wall or to supporting members inside the inflatable structure. A single tassel can be formed of a plurality of tassel strands of cord attached together at a joined end and separated at a loose ending. The tassel can also be formed as a single ribbon of fabric characteristically a long strip of rectangular fabric, but alternately as a coiled or other kind of shape such as a zigzag. A ribbon tassel may be laminate joined at a joined end and loose at a scattered ending. The laminate ribbon tassel may appear as a stacked deck of ribbons preferably of a variety of primary colors including colors such as red, orange, yellow, green, blue, indigo, and violet. Scrap fabric can be usefully recycled for offering a variety of colors. Alternatively, a few long streamers can be attached to the inside of the column wall. Although a single laminate ribbon streamer of substantial length can offer an entertaining visual display, multiple ribbon tassels offer a compounded visual effect.

The inverted cone is preferably placed below the number of tassels. The cone 180 has an exit aperture 260 larger than the input aperture 240. The cone 180 can be placed to begin at a base 110 and allow flow of air through the cone. The restriction at the air input 240 produces random turbulent flow allowing random and varied patterns of the tassels 150.

Figure one shows an inverted cone having an aperture exit facing the stream of tassels 150, however the cone can also have the exit aperture 260 smaller than the input aperture 240. The geometric inversion of the cone changes the airflow and the pattern of the tassels within the column of air. Instead of a cone, a portion of fabric restricting airflow can simulate the input aperture 240. A restriction such as the smaller input aperture 240 also creates turbulent flow blowing tassels up and down inside the clear column 160. The inverted cone member can be conical or of general funnel shape that is not strictly geometrically conical.

If a base member 110 is connected in fluid communication with the clear column allowing user jumping modulated air pressure to reach the input aperture 240, a user landing on the base 110 creates transient increased air pressure blowing air through the inverted cone 180 and affecting the visual display of blown tassels. The blown tassels may move according to user input.

Free-floating strips of material can also be introduced into the clear column of airflow. The free floating strips are preferably made of a light material and short enough in length to avoid entanglement with other free-floating strips or wall mounted ribbons or tassels.

The funnel directs air and blows the floating strips entrained in turbulent airflow. The funnel blows the free strips upward at the location near the constriction 240. When the strips encounter turbulent flow, the strips gradually slow in speed. As the airflow slows around the strip, and the strip velocity slows, the air no longer carries the free strip and the free-floating strips fall downward. A cycle of air circulates where a central axis has an airflow going up and the outside area near the surface of the clear column has downward air flow. The upper portion of the air motion is relatively stagnant. When the free-floating strips fall back to the constriction 240, the airflow carries the free-floating strips upward again. Strips having a large coefficient of aerodynamic drag are well suited for floating within an air chamber having turbulent flow. Strips show colorful flapping motion during flight.

The various airflows can be modified using screens or porous fabric allowing passage of airflow but not solid objects such as free-floating strips. Also, using screens that redirect airflow or slow airflow can modify the various airflows.

When a user is done playing with the inflatable structure and the event is over, the structure can be deflated and stored. The inflatable structure retains the tassels in storage configuration. The screens in the structure may retain the tassels if loose. When deflated, the tassels collapse into flat orientation and remain within the clear transparent column.

The invention claimed is:

1. A turbulent tassel column for an inflatable structure comprising: a clear column inflatable member containing fixed tassels held inside the column; the tassels adhered to an inside wall of the transparent column member; an inverted cone member held within the inflatable member directing airflow across tassels, for blowing tassels and creating visual motion effects; and a base member that is both inflatable and connected in fluid communication with the clear column allowing user jumping modulated air pressure to reach an input aperture, wherein the input aperture is disposed at a lower opening of the inverted cone member, wherein a user landing on the base member creates transient increased air pressure blowing through the inverted cone and affecting the visual motion effects of the tassels.

2. The inflatable jumper structure of claim 1, wherein the inverted cone member is made of transparent material.

3. The turbulent tassel column of claim 1, wherein the tassels are formed of loose individual strips of plastic.

4. The inflatable jumper structure of claim 1, wherein the wherein the tassels are formed of loose individual cords.

5. The turbulent tassel column of claim 1, wherein the tassels are formed of cords and attached to each other in bundles.

6. The inflatable jumper structure of claim 1, wherein the inverted cone member is conical.

7. The inflatable jumper structure of claim 1, wherein the inverted cone member is not conical.

8. A turbulent tassel column comprising: an inflatable clear column member containing tassels held inside the column; the tassels circulating freely within the transparent column member; an inverted cone member held within the inflatable member directing airflow blowing tassels, the inverted cone member has an exit aperture and an input aperture, the input aperture receiving air flow from the bottom of the column and directing air flow through an exit aperture, wherein tassels accumulating at the bottom of the input aperture received air flow arriving from the bottom of the column at the input aperture; and a base member that is inflatable and connected in fluid communication with the clear column allowing user jumping modulated air pressure to reach the input aperture, wherein the input aperture is disposed at a lower opening of the inverted cone member.

9. The inflatable jumper structure of claim 8 further comprising an inflatable base member in airflow communication with at least one clear column through the respective input aperture allowing user input affecting the visual effect of the tassels in at least one clear column, wherein a user landing on the base member creates transient increased air pressure blowing through the inverted cone and affecting the visual motion effects of the tassels.

10. The inflatable jumper structure of claim 8, wherein the inverted cone member is conical.

11. The inflatable jumper structure of claim 8, wherein the inverted cone member is not conical.

12. The inflatable jumper structure of claim 8, wherein the inverted cone member is made of transparent material.

13. The turbulent tassel column of claim 8, wherein the tassels are formed of loose individual strips of plastic.

14. The inflatable jumper structure of claim 8, wherein the wherein the tassels are formed of loose individual cords.

15. The inflatable jumper structure of claim 8, further comprising fixed tassels held inside the column; the fixed tassels adhered to an inside wall of the transparent column member.

16. The inflatable jumper structure of claim 15, further comprising an inflatable base member in airflow communication with at least one clear column through the respective input aperture allowing user input affecting the visual effect of the tassels in at least one clear column.

17. The inflatable jumper structure of claim 15, wherein the inverted cone member is made of transparent material.

* * * * *